United States Patent [19]

Nakade

[11] Patent Number: 5,022,599

[45] Date of Patent: Jun. 11, 1991

[54] CONTROLLER FOR A WINDING MACHINE

[75] Inventor: Kiyoshi Nakade, Komatsu, Japan

[73] Assignee: Tsudakoma Kogyo Kabushiki Kaisha, Kanazawa, Japan

[21] Appl. No.: 364,317

[22] Filed: Jun. 12, 1989

[30] Foreign Application Priority Data

Jun. 13, 1988 [JP] Japan ..... 63-145333

[51] Int. Cl.[5] ..... B65H 59/38; B65H 77/00

[52] U.S. Cl. ..... 242/75.51; 318/7; 226/195

[58] Field of Search ..... 242/75.51, 45; 226/45, 226/195; 318/6, 7

[56] References Cited

U.S. PATENT DOCUMENTS

| | | | |
|---|---|---|---|
| 3,223,906 | 12/1965 | Dinger | 318/7 |
| 3,372,320 | 3/1968 | Boyum et al. | 318/7 |
| 3,384,796 | 5/1968 | Shah | 318/7 |
| 3,762,663 | 10/1973 | Nedreski | 242/75.51 |

FOREIGN PATENT DOCUMENTS 53-12611 5/1978 Japan .

*Primary Examiner*—Stuart S. Levy
*Assistant Examiner*—Steven M. Dubois
*Attorney, Agent, or Firm*—Oblon, Spivak, McClelland, Maier & Neustadt

[57] ABSTRACT

A controller for a winding machine, for controlling the tension of a work running from a feed roller to a winding beam. The controller comprises a speed ratio control unit having a high response speed to control exactly the respective rotating speeds of a feed motor for driving the feed roller, and a winding motor for driving the winding beam during the decelerating operation of the winding machine to maintain the work at a tension substantially the same as a predetermined tension for stationary operation during the decelerating operation of the winding machine. The controller reduces time necessary for stopping the winding machine to the least extent.

11 Claims, 6 Drawing Sheets

CONTROLLER FOR A WINDING MACHINE

BACKGROUND ART

The present invention relates to a controller for controlling a winding machine which winds a work controlling the tension of the same, such as a slasher or a warp beaming machine which winds warp yarns controlling the tension of the same, and, more specifically, a controller for controlling a winding machine having excellent quick deceleration characteristics.

In a winding machine which controls the tension of the work extending between a feed roller and a winding beam at a predetermined value by individually driving the feed roller and the winding beam, the running speed of the work is regulated by controlling the rotating speed of either a motor driving the feed roller or a motor driving the winding beam, and the torque is regulated for tension control by controlling the rotating speed of the other motor so that the work is wound at a predetermined winding speed under a predetermined tension.

In such a case, generally, it is preferable to control either the feed roller or the winding beam, greater than the other in moment of inertia by a speed control system and to control the other smaller than the former in moment of inertia by a torque control system. The winding operation is controlled satisfactorily by operating the former at a predetermined rotating speed and the latter at a predetermined torque.

Japanese Patent Publication No. 53-12611 discloses a controller for such a winding machine. This known controller has a closed-loop speed control system, and a closed-loop torque control system provided with a tension deviation detector which detects the deviation of an actual tension from a set tension and amplifies the deviation. The differential signal of a speed setting signal for the speed control system is given to the torque control system to improve the tension control characteristics of the controller during the transient winding operation, such as acceleration or deceleration, of the winding machine by enhancing the response speed of the controller.

In such a known controller, only the derivative signal of the speed setting signal is given simply to the torque control system for the correction control of the torque control system during the acceleration or deceleration of the winding machine, and hence the tension control characteristics of the controller during deceleration to bring the winding machine to a quick stop were unsatisfactory.

A slasher, for example, which winds a warp consisting of a plurality of warp yarns, must be stopped even when one of the warp yarns is broken and restarted after piecing together the broken ends. If the slasher is not stopped in a short time, the broken warp yarn will be taken up on the warp beam to make mending the warp impossible. Accordingly, the slasher must be decelerated at a high rate to a quick stop when the warp yarn is broken, while the warp must be maintained at a predetermined tension. However, when the tension control system is kept in the foregoing operating mode in which the response speed is not sufficiently high, the slasher cannot be stopped in a desired short time without trouble.

DISCLOSURE OF THE INVENTION

Accordingly, it is a principal object of the present invention to provide a controller for a winding machine, capable of decelerating a winding machine to stop the winding machine in a sufficiently short time accurately maintaining the work at a predetermined tension.

| | |
|---|---|
| $R_1$ | Feed roller |
| $R_2$ | Winding beam |
| $M_1$ | Feed motor |
| $M_2$ | Winding motor |
| $n_1$, $n_2$ | Rotating speeds |
| A, $A_0$ | Speed ratios |
| $S_3$ | Deceleration command signal |

DETAILED DESCRIPTION OF THE PREFERRED EMBODIMENTS

Controllers in preferred embodiments according to the present invention will be described hereinafter with reference to the accompanying drawings.

First Embodiment

Figure 1:
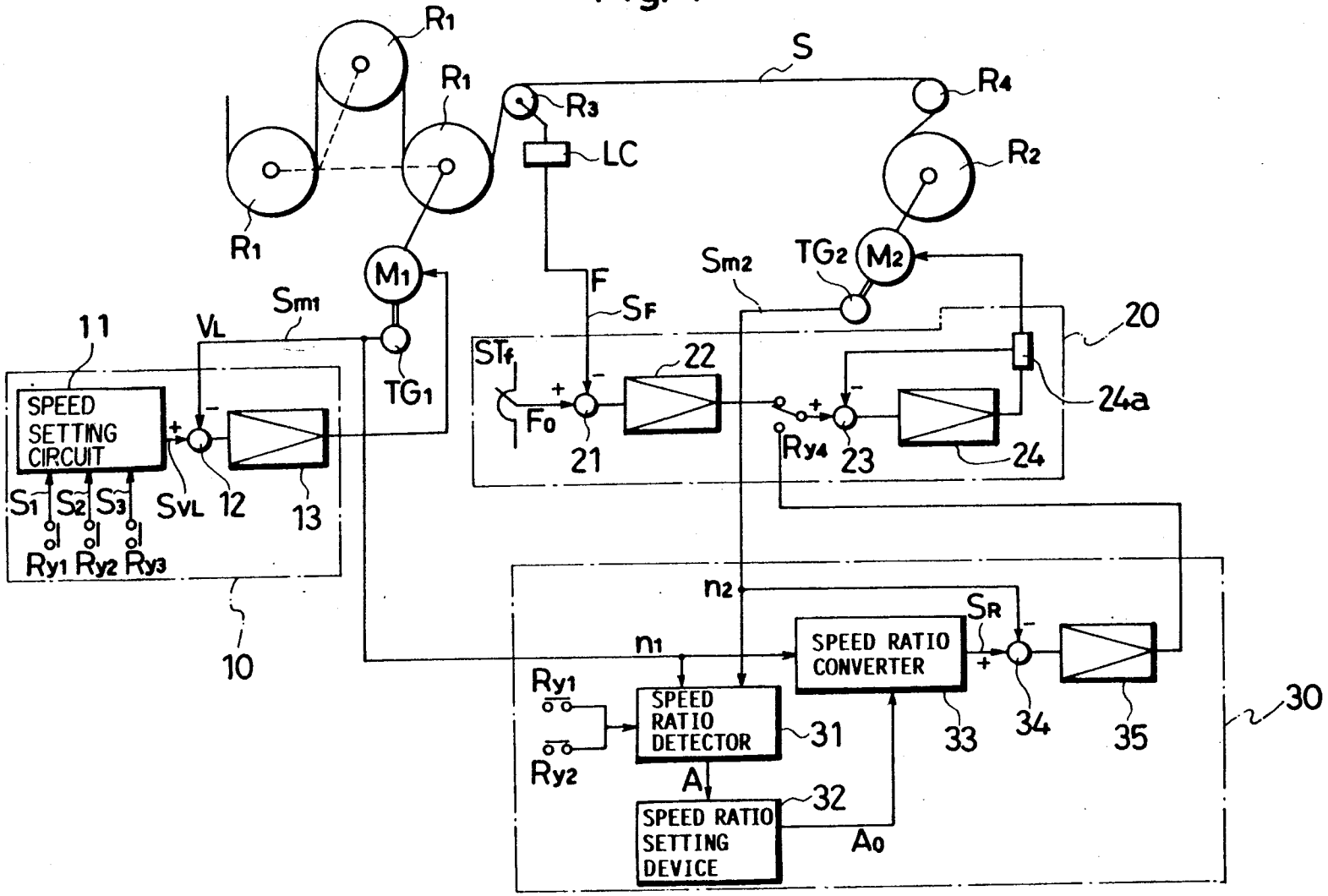
FIG. 1 is a block diagram of a controller in a first embodiment according to the present invention.

With reference to FIG. 1, a controller for a winding machine, i.e., a slasher in this case, comprises a speed control unit 10, a tension control unit 20 and a speed ratio control unit 30. A warp S is extended along a path including a zigzag section defined by a plurality of feed rollers $R_1$, and a straight section between a tension roller $R_3$ and a guide roller $R_4$. The warp is taken up by a winding beam $R_2$. The feed rollers $R_1$ are interlocked for synchronous rotation. The last feed roller $R_1$ is connected operatively to a feed motor $M_1$. A tachometer generator $TG_1$ is connected directly to the feed motor $M_1$.

The winding beam $R_2$ is connected operatively to a winding motor $M_2$. A tachometer generator $TG_2$ is connected to the winding motor $M_2$. A load cell LC is connected with the tension roller $R_3$ to detect the tension F of the warp S between the last feed roller $R_1$ and the winding beam $R_2$ and to provide a tension signal $S_F$ representing the tension F.

The speed control unit 10 comprises a speed setting circuit 11, a summing point 12 and a control amplifier 13, which are connected in series. Connected to the speed setting circuit 11 are relays $Ry_1$, $Ry_2$ and $Ry_3$, through which a low-speed operation command signal $S_1$, a high-speed operation command signal $S_2$ and a deceleration command signal $S_3$ are applied, respectively, to the speed setting circuit 11. The tachometer generator $TG_1$ applies a feed speed signal $S_{m1}$ to the subtraction terminal of the summing point 12. The output terminal of the control amplifier 13 is connected to the feed motor $M_1$.

Figure 2:
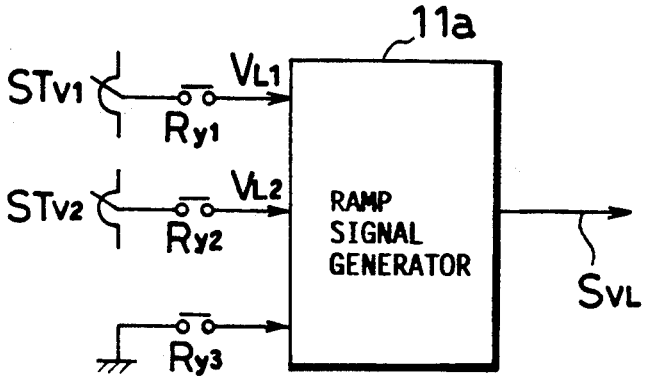
FIG. 2 is a block diagram of an essential portion of the controller of FIG. 1.
Figure 3:
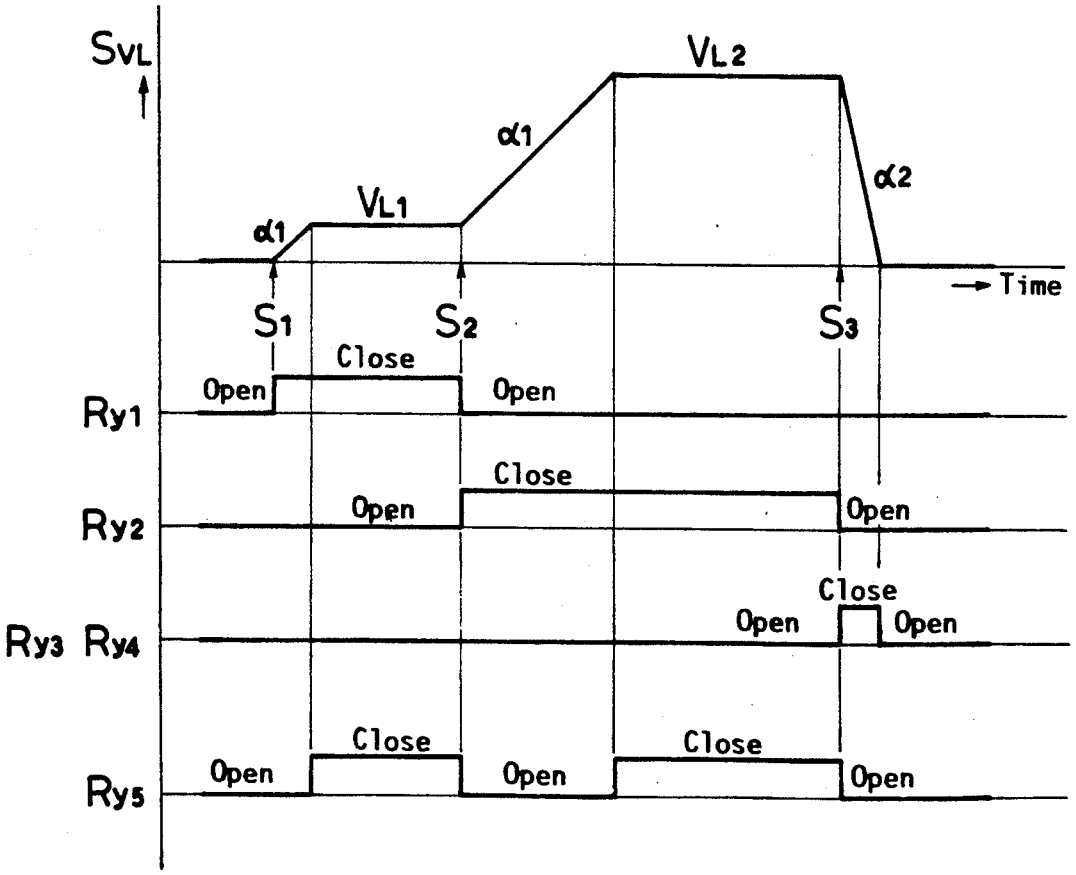
FIG. 3 is a diagram of assistance in explaining the operation of the controller of FIG. 1.

Referring to FIG. 2 the speed setting circuit 11 comprises a low operating speed setting device $ST_{v1}$ for setting a desired low operating speed $V_{L1}$ for the slasher, namely, a desired low running speed for the warp S, a high operating speed setting device $ST_{v2}$ for setting a desired high operating speed $V_{L2}$ for the slasher, namely, a desired high running speed of the warp S, and a ramp signal generator 11*a* for regulating accelerating rate $\alpha 1$ and decelerating rate $\alpha 2$ (FIG. 3). As shown in FIG. 3, the speed setting circuit 11 closes and opens the relays $Ry_1$, $Ry_2$ and $Ry_3$ sequentially to apply the outputs of the low operating speed setting device $ST_{v1}$ and the high operating speed setting device $ST_{v2}$, and zero potential sequentially to the ramp signal generator 11*a*. Consequently, the speed setting circuit 11 provides command signals representing the predetermined accelerating rate $\alpha 1$, the predetermined decelerating rate $\alpha 2$, the predetermined desired low operating speed $V_{L1}$ and the predetermined desired high operating speed $V_{L2}$.

Referring to FIG. 1, the tension control unit 20 comprises a tension setting device $ST_f$, a summing point 21, a control amplifier 22, a summing point 23 and a control amplifier 24, which are connected in series in that order. The load cell LC applies a tension signal $S_F$ to the subtraction terminal of the summing point 21. A transfer relay $Ry_4$ is interposed between the control amplifier 22 and the summing point 23. The output terminal of the control amplifier 24 is connected through a current detector 24*a* to the winding motor $M_2$. The output terminal of the current detector 24*a* is connected also to the subtraction terminal of the summing point 23.

Referring to FIG. 1, the speed ratio control unit 30 comprises a speed ratio detector 31, a speed ratio setting device 32, a speed ratio converter 33, a summing point 34 and a control amplifier 35 having a proportion element, an integration element or a differentiation element. The output terminal of the speed ratio converter 33 is connected through the summing point 34 to the control amplifier 35. The speed ratio detector 31 receives a feed speed signal $S_{m1}$ and a winding speed signal $S_{m2}$ respectively from the tachometer generators $TG_1$ and $TG_2$. The relays $Ry_1$ and $Ry_2$ are connected to an input terminal of the speed ratio detector 31. The output of the speed ratio detector 31 is given through the speed ratio setting device 32 to the speed ratio converter 33. The feed speed signal $S_{m1}$ is given also to the speed ratio converter 33. The winding speed signal $S_{m2}$ is applied also to the subtraction terminal of the summing point 34. The output terminal of the control amplifier 35 is connected to one of the contacts of the transfer relay $Ry_4$.

In starting the slasher, the relay $Ry_1$ is closed to give the low-speed operation command signal $S_1$ to the speed setting circuit 11. Consequently, the speed setting device $ST_{v1}$ is selected, and then the output signal of the ramp signal generator 11*a*, namely, the operating speed setting signal $S_{VL}$, increases at the predetermined accelerating rate $\alpha 1$ up to the desired low operating speed $V_{L1}$ and the operating speed of the slasher is maintained at the desired low operating speed $V_{L1}$ as shown in FIG. 3. That is, the feed motor $M_1$ is controlled by the speed control unit 10 according to the operating speed setting signal $S_{VL}$, and thereby the slasher is started and is accelerated until the operating speed $V_L$ reaches the desired low operating speed $V_{L1}$. Subsequently, the relay $Ry_2$ is closed to give the high-speed operation command signal $S_2$ to the speed setting circuit 11 and, consequently, the slasher is accelerated at the predetermined accelerating rate $\alpha 1$ until the operating speed reaches the desired high operating speed $V_{L2}$. Thereafter, the slasher continues operation at the desired high operating speed.

In the tension control unit 20, the control amplifier 24, the summing point 23 and the current detector 24*a* constitute a minor current control loop. Since the relay $Ry_4$ is switched to the control amplifier 22, a closed loop for tension control is formed to control the winding motor $M_2$ so that the tension F of the warp S detected by the load cell LC coincides with a set tension $F_0$ set by the tension setting device $ST_f$. Accordingly, even if the operating speed $V_L$ is varied as shown in FIG. 3, the tension control unit 20 controls the torque of the winding motor $M_2$ so that the tension F of the warp S always coincides with the set tension $F_0$.

During the stationary operation of the slasher, in which either the relay $Ry_1$ or the relay $Ry_2$ is closed, the speed ratio detector 31 of the speed ratio control unit 30 detects continuously the speed ratio $A = n_2/n_1$, where $n_1$ is the rotating speed of the feed motor $M_1$ represented by the feed speed signal $S_{m1}$ given to the speed ratio detector 31, and $n_2$ is the rotating speed of the winding motor $M_2$ represented by the winding speed signal $S_{m2}$ given to the speed ratio detector 31.

When the relay $Ry_3$ is closed to give the speed setting circuit 11 a deceleration signal $S_3$, the speed setting circuit 11 decreases the operating speed setting signal $S_{VL}$ at the high decelerating rate $\alpha 2$ to zero. Consequently, the feed motor $M_1$ is decelerated rapidly to stop the slasher. Since both the relays $Ry_1$ and $Ry_2$ connected to the speed ratio detector 31 are open during the deceleration of the feed motor $M_1$, the speed ratio detector 31 gives a signal representing the value of the speed ratio A at the moment when the relay $Ry_3$ is closed, namely, the value of the speed ratio A during the stationary operation, to the speed ratio setting device 32, the speed ratio setting device 32 stores the value of the speed ratio A and gives the value of the speed ratio A as a speed ratio $A_0$ for decelerating operation to the speed ratio converter 33. Since the feed speed signal $S_{m1}$ is applied to the speed ratio converter 33, the speed ratio converter 33 multiplies the rotating speed $n_1$ of the feed motor $M_1$ by the speed ratio $A_0$ to obtain the rotating speed $n_2$ for the winding motor $M_2$ and applies a speed command signal $S_R$ representing the rotating speed $n_2$ to the summing point 34.

The tachometer generator $TG_2$ applies continuously the winding speed signal $S_{m2}$ representing the actual rotating speed $n_2$ of the winding motor $M_2$ to the subtraction terminal of the summing point 34. When the relay $Ry_3$ is closed, the relay $Ry_4$ is switched from the control amplifier 22 to the control amplifier 35. Then, the summing point 34, the control amplifier 35, the summing point 23 and the control amplifier 24 construct a speed control system for controlling the rotating speed of the winding motor $M_2$ at a desired rotating speed represented by the speed command signal $S_R$. Thus, the rotating speed $n_2$ of the winding motor $M_2$ is controlled according to the rotating speed $n_1$ of the feed motor $M_1$ so that the speed ratio $A_0$ (=the value of the speed ratio A for the stationary operation immediately before the deceleration command signal $S_3$ is provided) is maintained.

The value of the speed ratio A ($=n_2/n_1$) for the stationary operation is determined so that the tension F of the warp S coincides with the predetermined tension $F_0$ and the speed ratio $A_0$ for the decelerating operation is equal to the value of the speed ratio A for the stationary operation, there is no possibility that the tension F deviates greatly from the predetermined tension $F_0$, even if the relay $Ry_4$ is switched to open the closed tension control loop including the control amplifiers 22 and 24 of the tension control unit 20. When the closed tension control loop is opened, the winding motor $M_2$ is subjected to the speed control of excellent response characteristics of the closed control loop including the control amplifiers 24 and 35. Accordingly, the winding motor $M_2$ can be controlled properly according to the rapid deceleration of the feed motor $M_1$. When the control amplifier 35 is provided with an integration element, further accurate follow-up control of the winding motor $M_2$ is possible by using the accumulation of the past data of deviation.

The relay $Ry_3$ can be closed to provide the deceleration command signal $S_3$ when one of the warp yarns of the warp S is broken as well as when the operator operates a stop switch to stop the slasher. That is, the rapid slasher decelerating and stopping operation can be achieved automatically by automatically closing the relay $Ry_3$ by a yarn breakage detection signal provided by an appropriate yarn breakage detector.

The relays $Ry_1$ and $Ry_2$ connected to the input terminal of the speed ratio detector 31 may be substituted by another relay $Ry_5$ which closes only while the slasher is operating at the desired low operating speed $V_{L1}$ or at the desired high operating speed $V_{L2}$ as shown in FIG. 3. When the relay $Ry_5$ is employed, the speed ratio detector 31 is allowed to detect the speed ratio A only while the relay $Ry_5$ is closed, so that the value of the speed ratio A during the transient operating state, namely, during the accelerating operation of the slasher, is not stored in the speed ratio setting device 32 even if yarn breakage occurs at any time and the deceleration command signal $S_3$ is provided, which enables further stable rapid decelerating and stopping control.

When necessary, the integration element of the control amplifier 35 is reset in a period other than the decelerating period to avoid the accumulation of deviation signals produced during the transient operating state of the slasher, namely, during the acceleration of the slasher. Furthermore, since the speed ratio detector 31 and the speed ratio converter 33 function only for determining the rotating speed $n_2$ by multiplying the rotating speed $n_1$ by the speed ratio A, the speed ratio detector 31 may calculate the speed ratio $n_1/n_2$ and the speed ratio converter 33 may be connected to the subtraction terminal of the summing point 34.

Modifications

The speed ratio control unit 30 is subject to modification.

Figure 4:
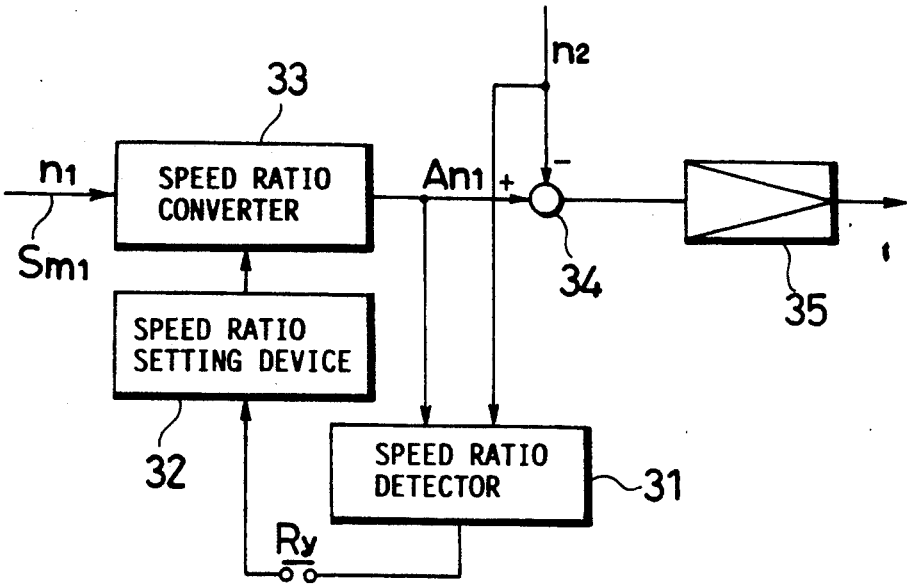
FIG. 4 is block diagram of a modification of the speed ratio control unit of the controller of FIG. 1.
Figure 5:
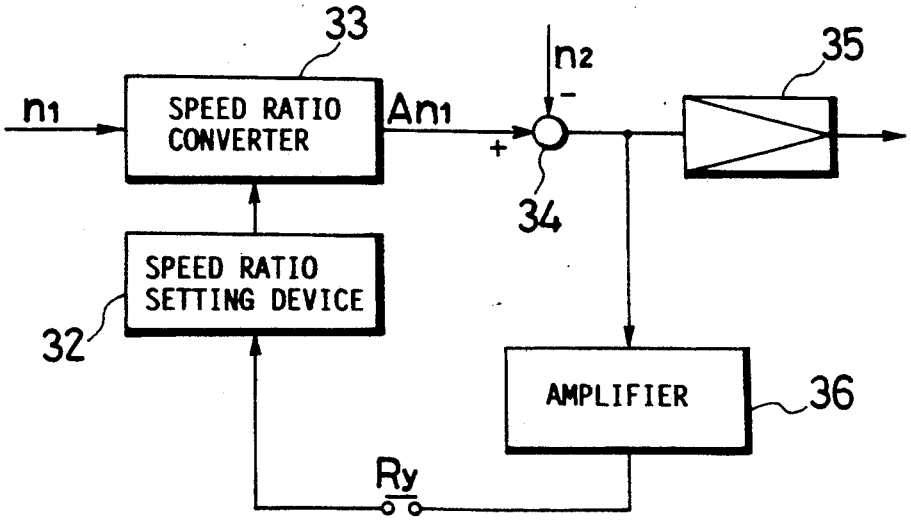
FIGS. 5, 6 and 7 are block diagrams of further modifications of the speed ratio control unit of the controller of FIG. 1.

For example, the feed speed signal $S_{m1}$ may be given to the speed ratio detector 31 through a line branching from a line connecting the speed ratio converter 33 to the summing point 34 as shown in FIG. 4. During the stationary operation, a relay Ry for timing the calculation of the speed ratio A is interposed between the speed ratio detector 31 and the speed ratio setting device 32. While the relay Ry is closed, the speed ratio detector 31 compares $An_1$ and $n_2$ and determines the value of the speed ratio A so that $An_1=n_2$ to update the speed ratio set by the speed ratio setting device 32, and the speed ratio converter 33, continues operating. When the deceleration command signal $S_3$ is provided, the relay Ry is opened and the value of the speed ratio A stored in the speed ratio setting device 32 at this moment is used during the decelerating operation. Thus, the modified speed ratio control unit 30 functions in the same manner as the speed ratio control unit 30 shown in FIG. 1.

Since the function of the speed ratio detector 31 of the speed ratio control unit 30 shown in FIG. 4 is only the detection of $An_1=n_2$, the speed ratio detector 31 may be substituted by an amplifier 36 connected to a line branched from a line connecting the summing point 34 to the control amplifier 35.

Figure 6:
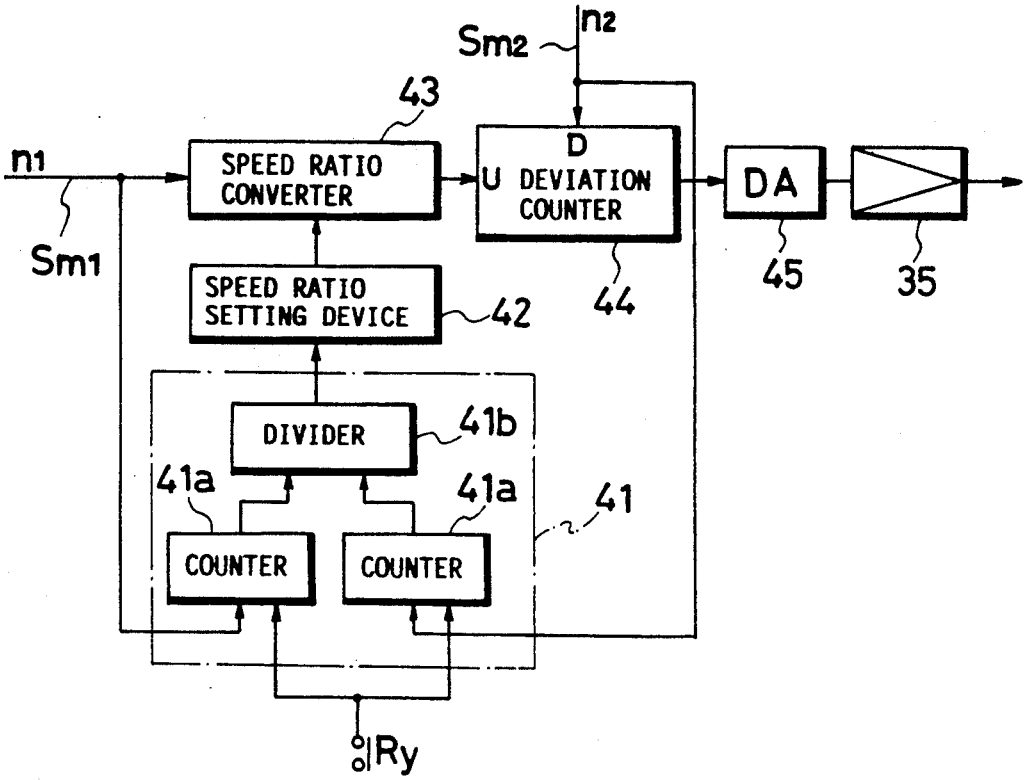

When both the feed speed signal $S_{m1}$ and the winding speed signal $S_{m2}$ are pulse signals, digital devices are used as the principal components of the speed ratio control unit 30. A speed ratio detector 41, a speed ratio setting device 42, a speed ratio converter 43, a deviation counter 44 and a DA converter 45 shown in FIG. 6 are digital devices. The speed ratio detector 41 consists of counters **41*a* respectively for receiving the feed speed signal $S_{m1}$ and the winding speed signal $S_{m2}$, and a divider 41*b* for processing the outputs of the counters 41*a*** through division.

The speed ratio detector 41, the speed ratio setting device 42, the speed ratio converter 43, the deviation counter 44 and the DA converter 45 shown in FIG. 6 correspond respectively to the speed ratio detector 31, the speed ratio setting device 32, the speed ratio converter 33 and the summing point 34 shown in FIG. 1. The deviation counter 44 calculates the difference between a pulse signal applied to the up-input terminal U thereof and a pulse signal applied to the down-input terminal D thereof. The counters **41*a* count the number of pulses of the feed speed signal $S_{m1}$ and the number of the winding speed signal $S_{m2}$, respectively, while the relay Ry is closed. The divider 41*b* calculates the speed ratio A between the contents of the counters 41*a* periodically or every time the contents of at least one of the counters 41*a* reaches a predetermined value, and then the divider 41*b* gives the speed ratio A to the speed ratio setting device 42. Naturally, data dealt with by the speed ratio setting device 42 and the speed ratio converter 42** must have significant digits in decimal places.

Figure 7:
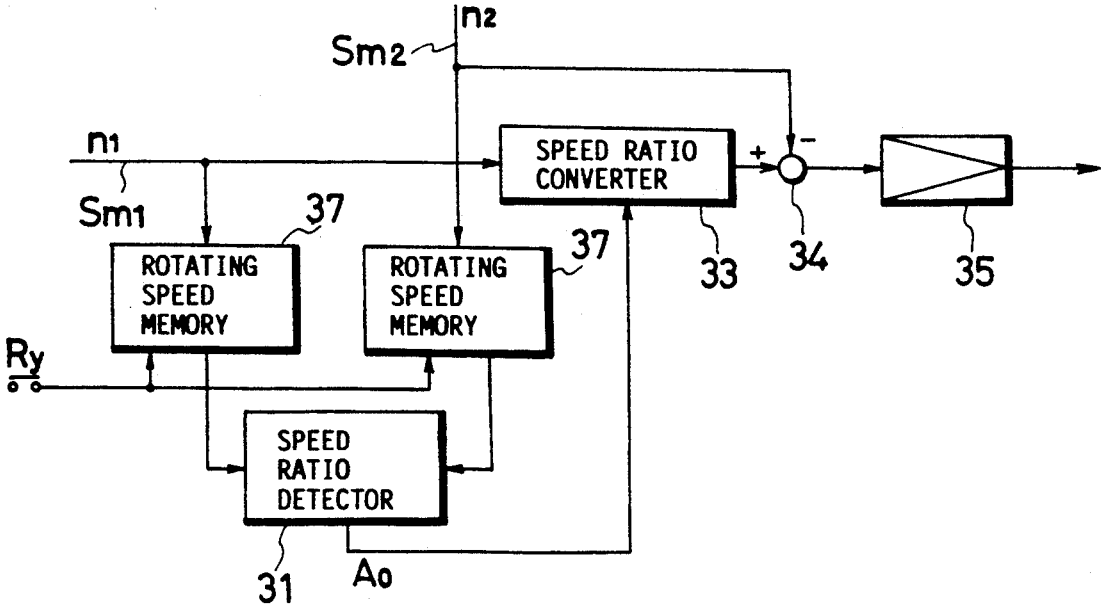

The speed ratio control unit 30 shown in FIG. 6 may be modified in a speed ratio control unit 30 comprising, in combination, rotating speed memories 37, a speed ratio detector 31 and a speed ratio converter 33 as shown in FIG. 7. The contents of the rotating speed memories 37 are updated by rotating speeds $n_1$ and $n_2$ detected while the relay Ry is closed. The speed ratio detector 31 calculates a speed ratio $A_0=n_2/n_1$ by using the rotating speeds $n_1$ and $n_2$ stored in the rotating speed memories 37 at the moment when the relay Ry is opened, and gives the speed ratio $A_0$ to the speed ratio converter 33.

Figure 8:
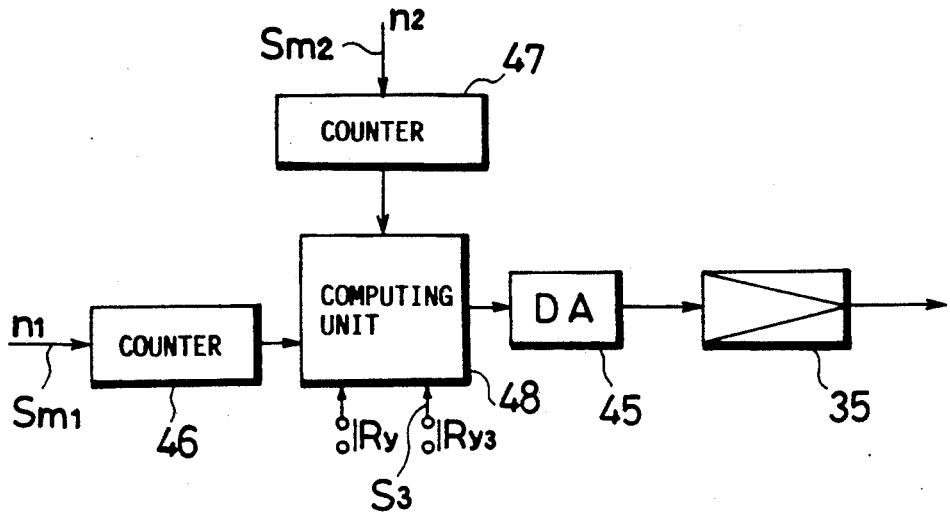
FIG. 8 is a block diagram of an essential portion of a controller in a second embodiment according to the present invention, corresponding to the essential portion shown in FIG. 4.

The functions of the foregoing speed ratio control units in accordance with the present invention can be simply carried out by a speed ratio control unit 30 including a microcomputer (computing unit 48) as shown in FIG. 8. The respective counts $N_1$ and $N_2$ of the feed speed signal $S_{m1}$ and the winding speed signal $S_{m2}$ are counted by counters 46 and 47, and relays Ry and $Ry_3$ are connected to the computing unit 48.

The operation of the speed ratio control unit 30 shown in FIG. 8 will be described hereinafter with reference to a flow chart shown in FIG. 9.

In step 1, a query is made to see if the relay Ry is closed. When the response in step 1 is affirmative, a query is made in step 2 to see if the contents $N_1$ of the counter 46 is not less than a constant N. When the response in step 2 is affirmative, the speed ratio $A=N_2/N_1$ is calculated and stored in a memory in step 3, and then the counters 46 and 47 are cleared in step 4.

When the relay Ry is open and the relay $Ry_3$ is closed to provide a deceleration command signal $S_3$, namely, when the response in step 1 is negative and the response in step 5 is affirmative, a value $An_1$ is calculated by using the rotating speed $n_1$ and the latest value of the speed ratio A and the difference between the value $An_1$ and the rotating speed $n_2$ is accumulated in step 6, and then the the cumulative value is given to the DA converter 45 in step 8. The rotating speeds $n_1$ and $n_2$ are represented by the counts $N_1$ and $N_2$ counted by the counters 46 and 47. An appropriate calculated result X having significant digits of decimal places can be obtained in step 6 because the speed ratio A has significant digits of decimal places. After the relay $Ry_3$ has been opened and the decelerating operation has been completed, the calculated value X and the counts $N_1$ and $N_2$ are cleared, and then the speed ratio control unit 30 returns to a standby state.

Figure 9:
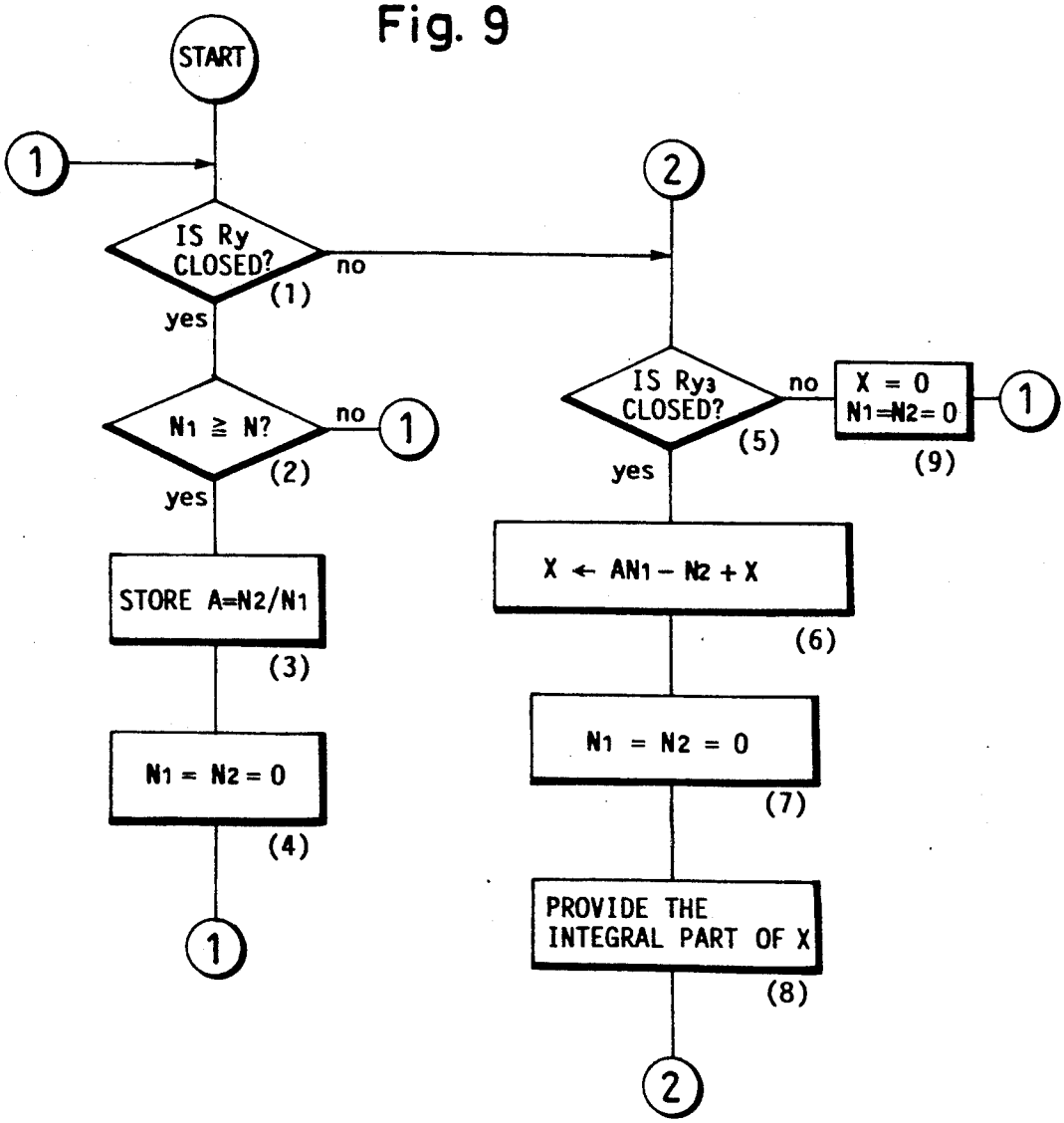
FIG. 9 is a flow chart of a program to be executed by the essential portion shown in FIG. 8.

Apparently, step 3 of FIG. 9 corresponds to the operation of the speed ratio detector 31 and the speed ratio setting device 32 of FIG. 1, and steps 6 and 8 correspond to the operation of the speed ratio converter 33 of FIG. 1. The effect of calculating $A=N_1/N_2$ in step 3 and calculating $X=N_1-AN_2+X$ in step 6 is equivalent to that of connection of the speed ratio converter 33 to the subtraction terminal of the summing point 34 in FIG. 1.

In the foregoing embodiments, $(1+\delta)A$ and $(1+\delta)A_0$ ($\delta$ is a small positive number on the order of 0.01 or less) may be used instead of the speed ratios A and $A_0$ calculated by the speed ratio detector 31 and the like, stored in the speed ratio setting device 32 or the like and used by the speed ratio converter 33 and the like during the decelerating operation to prevent the accidental slackening of the warp S during the deceleration of the slasher by setting the rotating speed $n_2$ of the winding motor $M_2$ at a rotating speed slightly higher than the predetermined rotating speed for the stationary operation.

Figure 10:
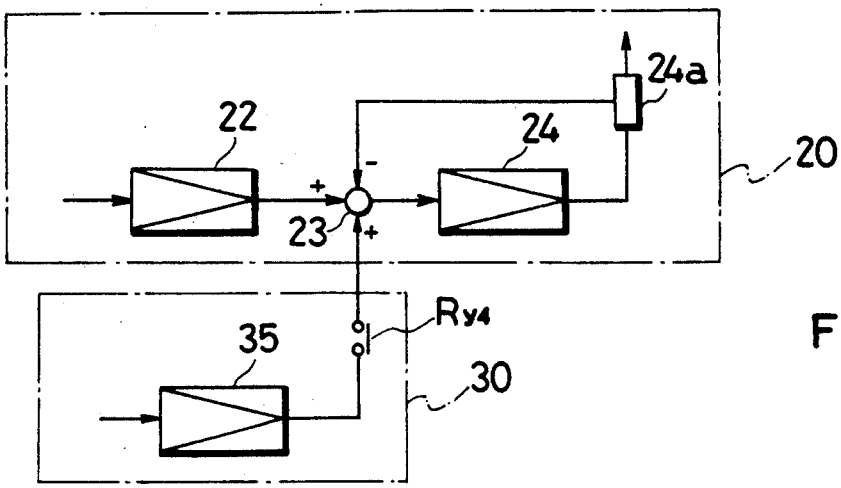
FIGS. 10 and 11 are block diagrams of essential portions of controllers in third and fourth embodiments according to the present invention.
Figure 11:
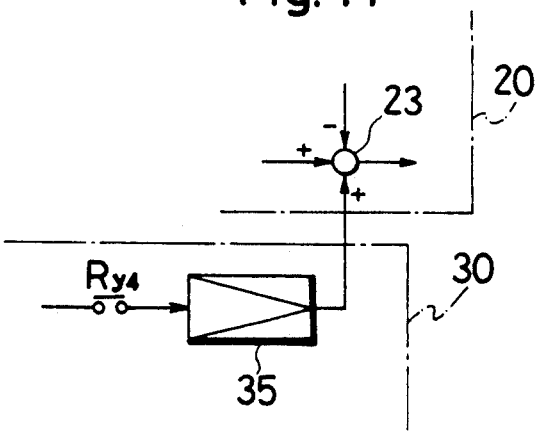

The output of the speed ratio control unit 30 may be applied to the add terminal of the summing point 23 of the tension control unit 20 as shown in FIG. 10 without opening the closed loop of the tension control unit 20 to enable the control unit to change the control mode thereof smoothly for a deceleration control mode by suppress disturbance affecting the control amplifier 24. In such a case, the tension control system including the control amplifier 22 continues its operation during the decelerating operation. However, the continuous operation of the tension control system does not affect the operation of the speed ratio control unit 30 adversely because the response speed of the tension control system is sufficiently low. The relay $Ry_4$ for starting the control operation of the speed ratio control unit 30 may be connected to either the output terminal or input terminal of the control amplifier 35 (FIG. 11).

Although the response speed of the tension control system is low, the deviation signal of the tension control system applied through the control amplifier 22 to the summing point 23 tends to cancel the effect of the value $\delta$ used by the speed ratio control unit 30. Therefore, it is desirable to change the set tension $F_0$ for a tension $(1+\delta)F_0$ upon the closing of the relay $Ry_4$, when the speed ratios $(1+\delta)A$ and $(1+\delta)A_0$ are used with the speed ratio control unit 30 connected to the summing point 23 of the tension control unit 20 without opening the closed loop of the tension control unit 20 as shown in FIGS. 10 and 11.

Figure 12:
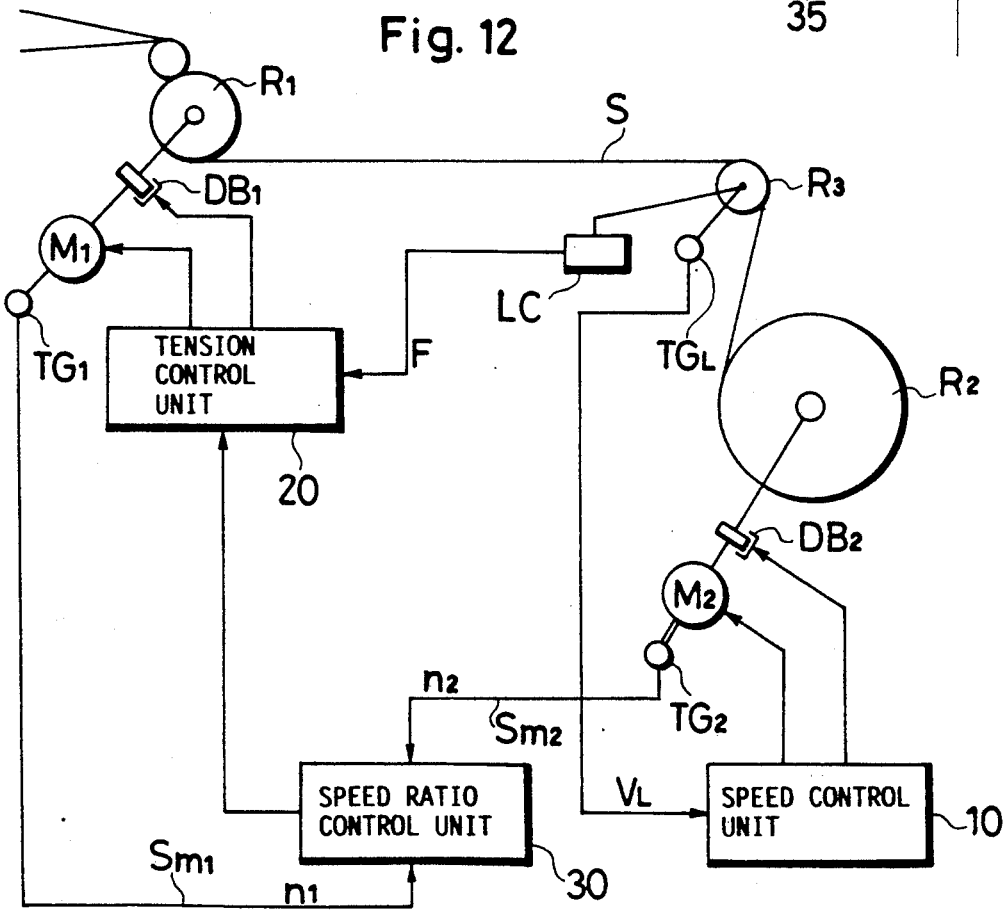
FIG. 12 is a block diagram of a controller in a fifth embodiment according to the present invention, corresponding to FIG. 1.

The controller of the present invention is applicable also to a winding machine, such as a warp beaming machine, in which a feed motor $M_1$ is controlled by the tension control unit 20, and a winding motor $M_2$ is controlled by the speed control unit 10 as shown in FIG. 12. In this case, the speed control unit 10 controls the rotating speed of the winding motor $M_2$ on the basis of a signal generated by the tachometer generator $TG_L$ associated directly with the tension roller $R_3$ to measure the operating speed $V_L$ of the winding machine, the tension control unit 20 controls the torque of the feed motor $M_1$ on the basis of the tension F detected by the load cell LC, while the speed ratio control unit 30 receives signals representing the respective rotating speeds $n_1$ and $n_2$ of the feed motor $M_1$ and the winding motor $M_2$, and controls the rotating speed of the feed motor $M_1$ according to the rotating speed of the winding motor $M_2$ during the decelerating operation. On the other hand, the feed motor $M_1$ and the winding motor $M_2$ are provided respectively with auxiliary braking devices $DB_1$ and $DB_2$, which are controlled respectively by the tension control unit 20 and the speed control unit 10, to supplement the deficient decelerating torques of the feed motor $M_1$ and the winding motor $M_2$.

The present invention is applicable also to various winding machines for winding a work under controlled tension, having a feed motor $M_1$ for driving a feed roller $R_1$, and a winding motor $M_2$ for driving a winding beam $R_2$.

As is apparent from the foregoing description, according to the present invention, the rotating speed of the motor controlled by the tension control unit is controlled according to the rotating speed of the motor controlled by the speed control unit during the decelerating operation by the speed ratio control unit on the basis of the speed ratio between the respective rotating speeds of the feed motor and the winding motor for the stationary operation, and the tension of the work is maintained at a level substantially the same as that of a predetermined tension for the stationary operation by the speed ratio control unit having a high response speed. Thus, the present invention curtails time necessary for stopping the winding machine remarkably.

What is claimed is:

1. A controller for a winding machine, for controlling the tension of work running from a feed roller to a winding beam, comprising:

a feed roller control unit for controlling the rotating speed of a feed motor for driving the feed roller to control operation speeds of said winding machine; and a winding beam control unit for controlling the rotating speed of a winding motor for driving the winding beam to control the tension of the work being wound;

said winding beam control unit comprising a tension control unit and a speed ratio control unit;

said tension control unit controlling the rotating speed of the winding motor for matching a detected tension of the work to a set tension of the work; and said speed ratio control unit controlling the rotating speed of the winding motor for adjusting said winding motor speed to a value of a detected rotating speed of the feed motor multiplied by a speed ratio between respective rotating speeds of the feed motor and the winding motor during a stationary operation of the winding machine.

2. A controller for a winding machine, for controlling the tension of work running from a feed roller to a winding beam, comprising:

a winding beam control unit for controlling the rotating speed of a winding motor for driving the winding beam to control operation speeds of said winding machine; and a feed roller control unit for controlling the rotating speed of a feed motor for driving the feed roller to control the tension of the work being wound;

said feed roller control unit comprising a tension control unit and a speed ratio control unit;

said tension control unit controlling the rotating speed of the feed motor for matching a detected tension of the work to a set tension of the work; and said speed ratio control unit controlling the rotating speed of the feed motor for adjusting said winding motor speed to a value of a detected rotating speed of the winding motor multiplied by a speed ratio between respective rotating speeds of the feed motor and the winding motor during a stationary operation of the winding machine.

3. A controller for a winding machine, according to claim 1 or 2, wherein said speed ratio control unit comprises a speed ratio detector for detecting the ratio between the rotating speed of the feed motor and that of the winding motor, a speed ratio setting device for storing the latest speed ratio, and a speed ratio converter for determining the rotating speed of either the feed motor or the winding motor on the basis of the rotating speed of the other and the latest speed ratio stored in the speed ratio setting device during the decelerating operation of the winding machine.

4. A controller for a winding machine, according to claim 1 or 2, wherein said speed ratio control unit comprises a rotating speed memory for storing the respective rotating speeds of the feed motor and the winding motor, a speed ratio detector for detecting the ratio between the rotating speed of the feed motor stored in the rotating speed memory and that of the winding motor stored in the rotating speed memory, and a speed ratio converter for determining the rotting speed of either the feed motor or the winding motor on the basis of the rotating speed of the other and the speed ratio detected by the speed ratio detector.

5. A controller for a winding machine, according to claim 1 or 2, wherein said tension control unit comprises a means for opening a closed controlling circuit of said tension control unit, and said speed ratio control unit comprises a means for being connected to said tension control unit, when a deceleration command signal is provided.

6. A controller for a winding machine, according to claim 1 or 2, wherein said speed ratio control unit comprises a means for being connected to said tension control unit without opening a closed controlling circuit of said tension control unit, when a deceleration command signal is provided.

7. A controller for a winding machine according to claim 1, wherein said speed ratio control unit comprises counters respectively for counting the rotating speed of the feed motor and that of the winding motor, and a computing unit which calculates the speed ratio between the respective rotating speeds of the feed motor and the winding motor by using contents of the counters, and determines the rotating speed of the winding motor by using the speed ratio and the rotating speed of the feed motor.

8. A controller for a winding machine according to claim 2, wherein said speed ratio control unit comprises counters respectively for counting the rotating speed of the feed motor and that of the winding motor, and a computing unit which calculates the speed ratio between the respective rotating speeds of the feed motor and the winding motor by using contents of the counters, and determines the rotating speed of the winding motor by using the speed ratio and the rotating speed of the feed motor.

9. A controller for a winding machine according to claim 7, comprising:

said computing unit storing said calculated speed ratio;

means for providing a deceleration command signal to said computing unit; and means for determining a difference between said rotating speed of said feed motor multiplied by said stored speed ratio and said rotating speed of said winding motor;

wherein said calculated difference is used to control said speed ratio control unit thereby maintaining said tension of said work being wound during a deceleration operation.

10. A controller for a winding machine according to claim 8, comprising:

said computing unit storing said calculated speed ratio;

means for providing a deceleration command signal to said computing unit; and means for determining a difference between said rotating speed of said feed motor multiplied by said stored speed ratio and said rotating speed of said winding motor;

wherein said calculated difference is used to control said speed ratio control unit thereby maintaining said tension of said work being wound during a deceleration operation.

11. A controller for a winding machine, according to claim 1 or 2, wherein said speed ratio control unit comprises a means for starting operation of the speed ratio control unit during a deceleration operation of the winding machine.

* * * * *